US005619780A

United States Patent [19]

Potter

[11] Patent Number: 5,619,780

[45] Date of Patent: Apr. 15, 1997

[54] PRODUCTION OF TEXTURED YARN AND METHOD FOR CONTAINING SAID YARN

[75] Inventor: Jerry F. Potter, Seaford, Del.

[73] Assignee: E. I. Du Pont de Nemours and Company, Wilmington, Del.

[21] Appl. No.: 524,684

[22] Filed: Sep. 7, 1995

Related U.S. Application Data

[63] Continuation-in-part of Ser. No. 283,019, Jul. 29, 1994, abandoned.

[51] Int. Cl.[6] ..... D02G 1/12

[52] U.S. Cl. ..... 28/256; 28/258

[58] Field of Search ..... 28/172.1, 172.2, 28/173, 177, 185, 193, 220, 221, 248, 258, 272; 57/22, 264, 90, 13; 226/91, 92, 97

[56] References Cited

U.S. PATENT DOCUMENTS

| | | | |
|---|---|---|---|
| 2,289,860 | 7/1942 | Babcock | 18/8 |
| 2,333,267 | 11/1943 | Modigliani | 28/1 |
| 3,186,155 | 6/1965 | Breen et al. | 57/140 |
| 3,286,896 | 11/1966 | Kinney | 226/97 |
| 3,381,869 | 5/1968 | Smith | 226/97 |
| 3,511,625 | 5/1970 | Pitt | 65/4 |
| 3,684,143 | 8/1972 | Juppet | 226/97 |
| 4,280,260 | 7/1981 | Martin et al. | 28/257 |
| 4,295,329 | 10/1981 | Windley | 28/257 |
| 4,356,604 | 11/1982 | Martin et al. | 28/257 |
| 4,526,808 | 7/1985 | Strohmaier | 28/157 |
| 4,588,497 | 12/1986 | Oseald et al. | 28/258 |
| 4,880,177 | 11/1989 | Lenk | 242/47.01 |
| 4,908,919 | 3/1990 | Irvine | 28/250 |

*Primary Examiner*—C. D. Crowder
*Assistant Examiner*—Larry D. Worrell, Jr.

[57] ABSTRACT

A method for detecting a yarn break between the cooling drum and the windup in a yarn bulking process and containing the broken end to prevent the broken end from interrupting adjacent threadlines. The yarn, when broken, is contained in individual tubes extending along the yarn path to prevent the yarn from interrupting adjacent yarn lines. The yarn is recaptured from the tube by a jet moveable into and out of engagement with the tube.

1 Claim, 4 Drawing Sheets

PRODUCTION OF TEXTURED YARN AND METHOD FOR CONTAINING SAID YARN

BACKGROUND OF THE INVENTION

This is a continuation-in-part of Application Ser. No. 08/283,019 filed Jul. 29, 1994 and now abandoned.

This invention relates to the production of multiple ends of textured yarn, and more particularly, it relates to preventing the breakdown of adjacent ends of such yarns upon the occurrence of a breakdown of one such end upstream of the cooling drum.

Methods and apparatus for texturing yarn are well known. One such method is described in U.S. Pat. No. 4,908,919. In order to improve productivity, methods for texturing such yarns have included processing multiple ends of such yarns in a side-by-side relationship using a common rotating cooling drum. However using this side-by-side method of producing textured yarns provides the opportunity for a breakdown of a threadline in the process downstream of the drum to interrupt or breakdown adjacent threadlines, which is highly undesirable.

SUMMARY OF THE INVENTION

A method for bulking a plurality of yarns traveling side-by-side that includes the steps of heating, stretching, and passing each of said yarns through a bulking jet then forming the resultant bulked yarn into a plug and cooling the plug on a rotating drum, withdrawing said bulked yarns from said plugs, and forwarding them in paths to a windup the improvement for capturing said bulked yarns when one or more of said yarns have been interrupted between said drum and said windup comprising: containing each of said bulked yarns in an open-ended tube extending along said yarn path from said drum toward said windup to prevent the yarn when interrupted from entangling with yarn in adjacent paths and interrupting adjacent yarns, and recapturing said yarn when interrupted from said tube by means of a vacuum applied to the outlet end of said tube by a jet moveable into and out of engagement with said outlet end.

The jet is moved into engagement with the outlet end of said tube when a threadline motion sensor detects absence of the threadline between the outlet end of the tube and the windup.

DETAILED DESCRIPTION OF THE ILLUSTRATED EMBODIMENT

Figure 1:
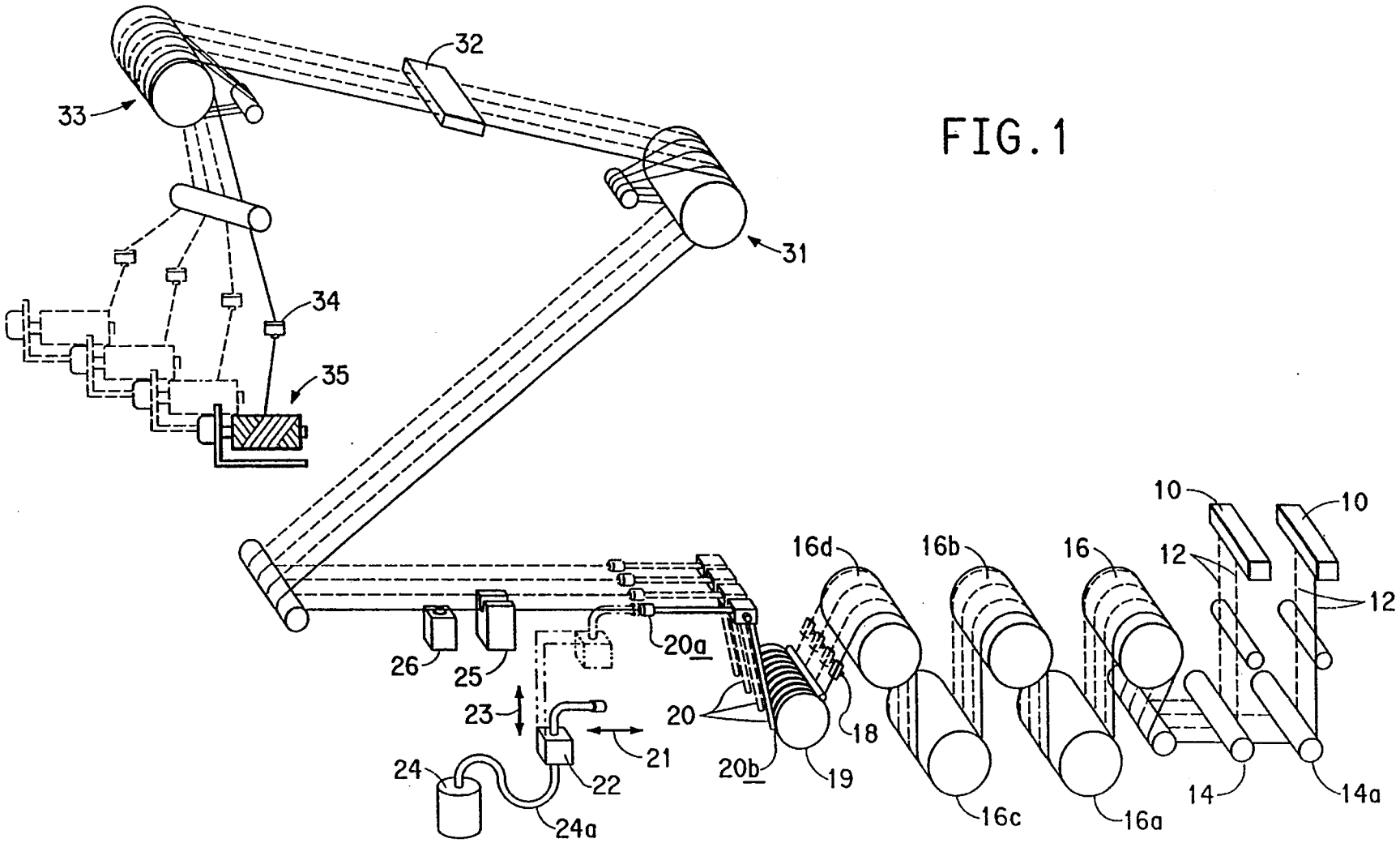
FIG. 1 is a schematic illustration of a multi-end texturing process useful in the practice of this invention.

The process chosen for purposes of illustration in FIG. 1 includes a plurality of separate threadlines 12 being spun as filaments from a spinneret 10 and each threadline is passed around a series of feed rolls 14–14A to establish the spun denier of the undrawn filaments. A fixed amount of elongation in the threadlines 12 is obtained by setting the speed of draw rolls 16–16D with respect to feed rolls 9–9B to develop the final denier and physical properties of the threadlines 12.

The threadlines are next forwarded to jet bulking devices 18. In the jets 18 the threadlines 12 are subjected to the bulking action of a hot fluid. The hot fluid exhausts with the threadline against a rotating drum 19 having a perforated surface on which the yarn cools to set the crimp. From the drum, each threadline in a crimped or bulked form passes to a series of open-ended tubes 20 which deliver each threadline to a package winder generally designated as 35.

Figure 2:
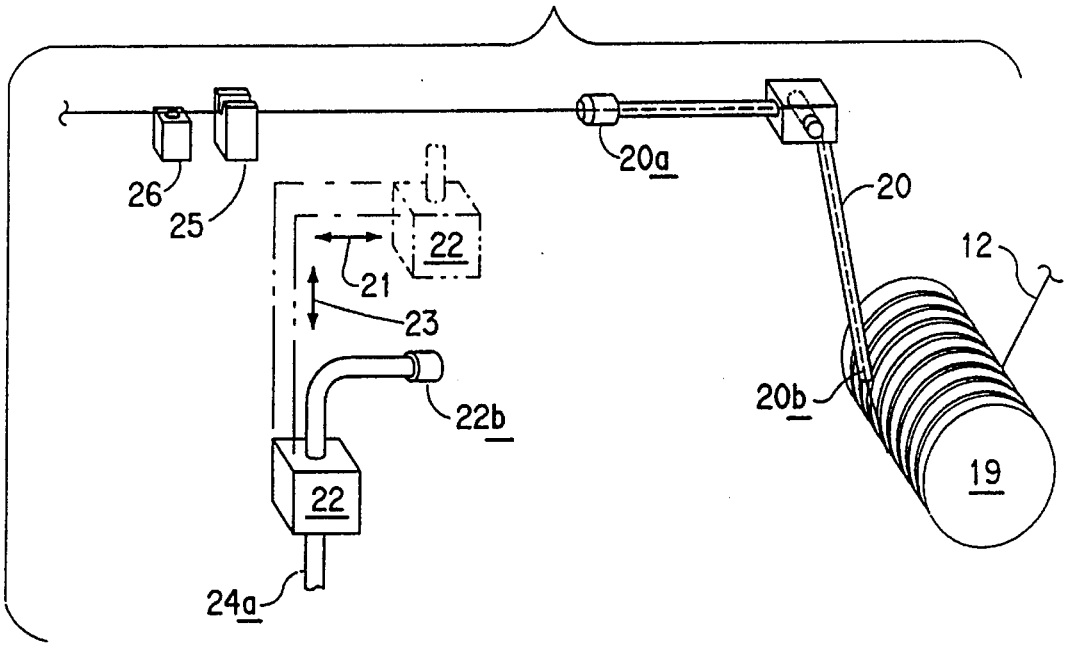
FIGS. 2–6 are schematic illustrations of the system showing recapturing and restringing a broken threadline downstream of the cooling drum.
Figure 3:
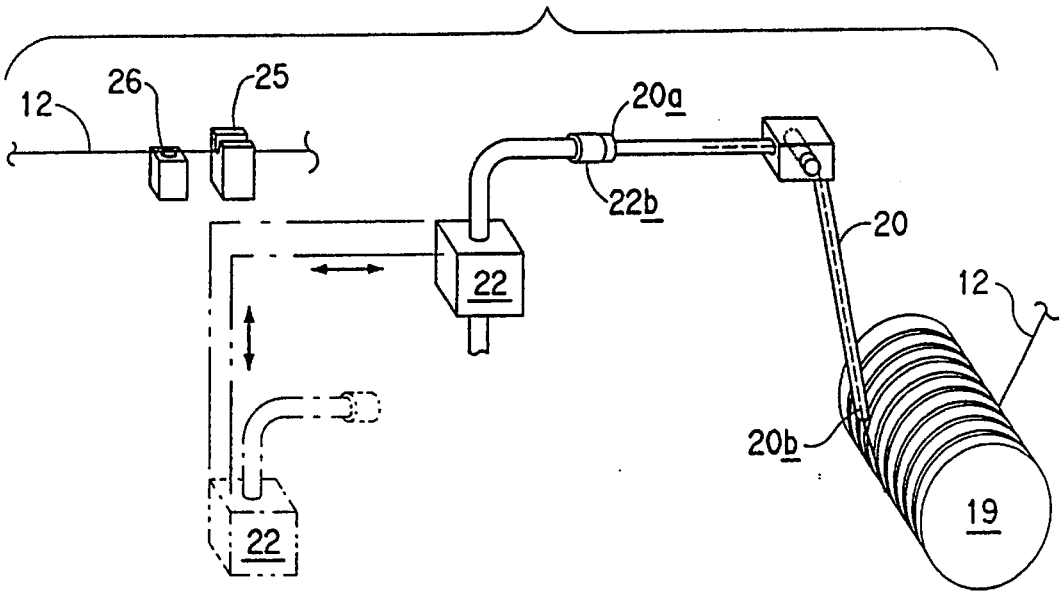
Figure 4:
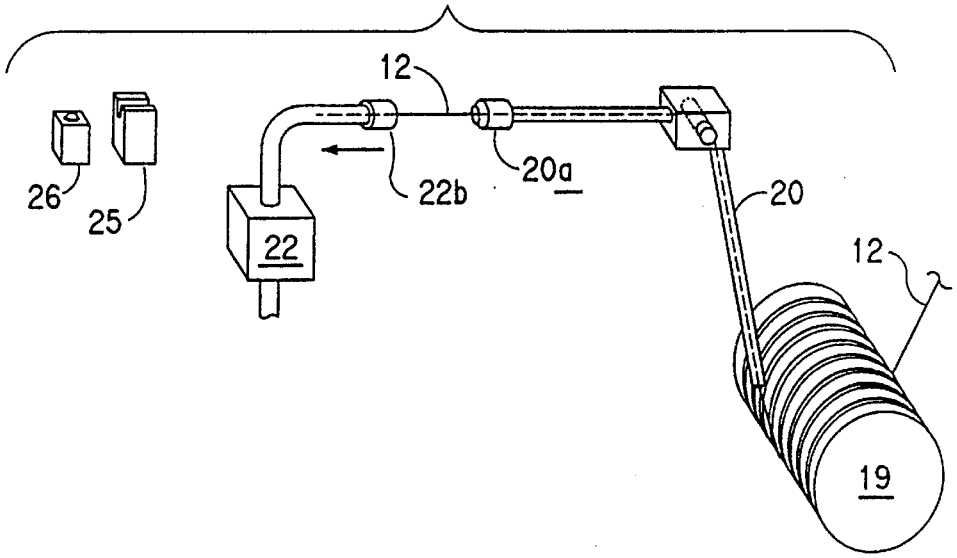
Figure 5:
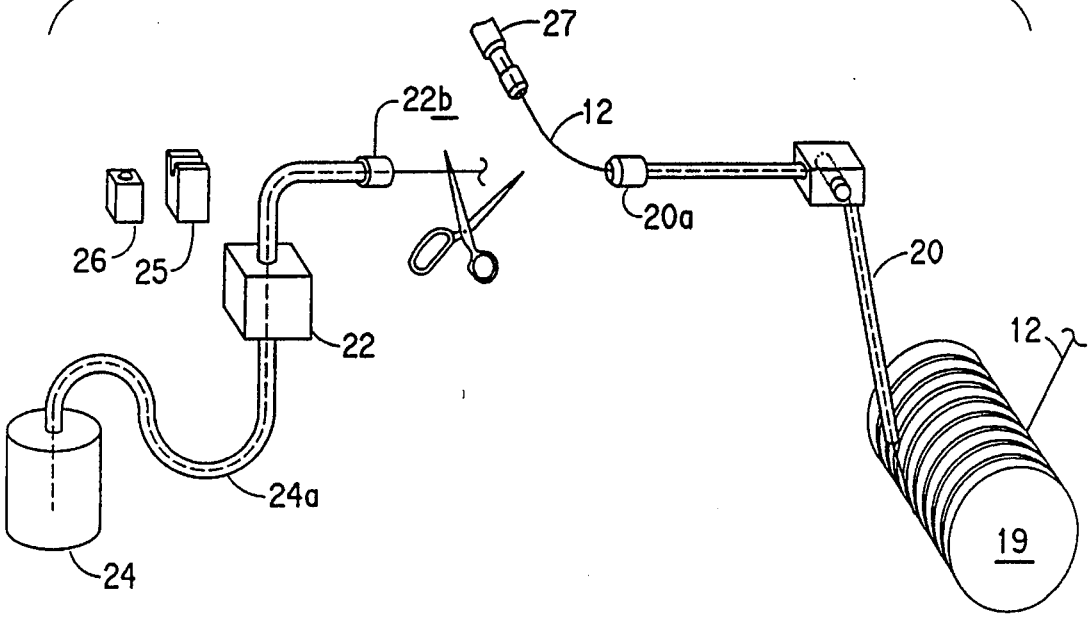
Figure 6:
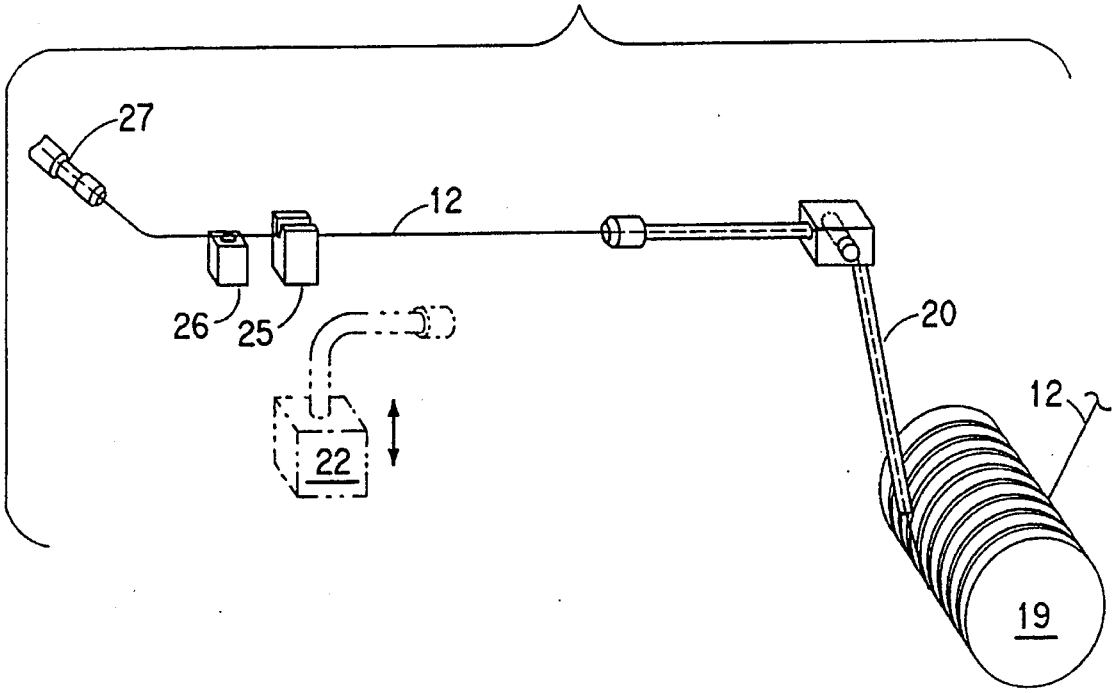
Figure 7:
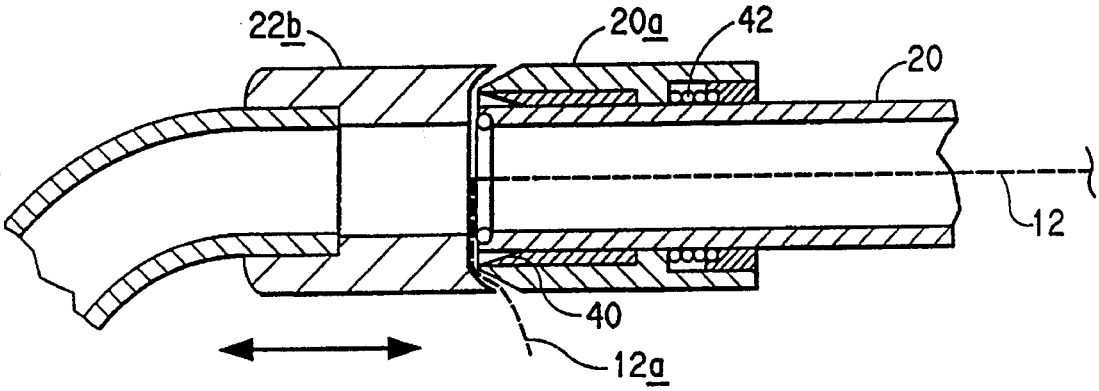
FIG. 7 is a cross-sectioned view of the outlet end 20*a* of tube 20 showing a threadline cutter built into the outlet end to cut off the tail of a threadline downstream of jet 22.

FIGS. 2–6 illustrate the method for initial string-up of a threadline 12 from the drum 19 through the tube 20 or the recapture of a broken threadline contained in tube 20. As shown in FIGS. 2 and 3, a jet 22 is moveable into and out of engagement with the outlet end 20*a* of table 20. The inlet end 20*b* of the tube 20 is adjacent the threadline on the drum. The jet 22 and its inlet end 22*b* is moved into and out of engagement with tube outlet 20*a* by means of a pneumatically powered a 2-axis mechanism (not shown) but represented by direction arrows 21 and 23. The mechanism consists of two dual rod air cylinders (Model CXSM20-30 and CXSM20-50 by SMC Cylinder Company of Japan) coupled to the jet. Both air cylinders have 20 mm diameters. A 30 mm stroke cylinder is used for horizontal motion and 50 mm stroke cylinder is used for vertical movement.

What is claimed is:

1. In a method for bulking a plurality of yarns traveling side-by-side that includes the steps of heating, stretching, and passing each of said yarns through a bulking jet then forming each of the resultant bulked yarns into plugs and cooling the plugs on a rotating drum, withdrawing said bulked yarns from said plugs, and forwarding them in paths to a windup the improvement comprising: capturing said bulked yarns when at least one of said yarns have been interrupted between said drum and said windup by containing each of said bulked yarns in individual tubes extending along said yarn paths from said drum toward said windup to prevent the yarn when interrupted from entangling with yarn in adjacent paths and interrupting adjacent yarns, recapturing said yarn from said tube by means of a vacuum applied to the outlet end of said tube by means of a jet moveable into and out of engagement with said outlet end.

* * * * *